United States Patent [19]

Inaba et al.

[11] Patent Number: 4,665,338

[45] Date of Patent: May 12, 1987

[54] FRONT END ELEMENTS FOR A COLOR CATHODE RAY TUBE

[75] Inventors: Michihiko Inaba, Kanagawa; Masaharu Kanto, Hyogo; Satoshi Shikanai, Kanagawa; Yasuhisa Ohtake, Saitama, all of Japan

[73] Assignee: Kabushiki Kaisha Toshiba, Japan

[21] Appl. No.: 647,924

[22] Filed: May 17, 1984

[30] Foreign Application Priority Data

May 17, 1983 [JP] Japan ..... 58-86081

[51] Int. Cl.[4] ..... H01J 29/80

[52] U.S. Cl. ..... 313/402; 313/407

[58] Field of Search ..... 313/402, 403, 407, 458

[56] References Cited

U.S. PATENT DOCUMENTS

| | | | |
|---|---|---|---|
| 3,760,214 | 9/1973 | Yamazaki et al. | 313/402 |
| 3,804,601 | 4/1974 | Kaplan | 313/402 |
| 4,285,106 | 8/1981 | Alder | 313/407 |
| 4,292,565 | 9/1981 | Kanto | 313/407 |

FOREIGN PATENT DOCUMENTS

| | | | |
|---|---|---|---|
| 2231101 | 4/1975 | France . | |
| 0126859 | 11/1978 | Japan | 313/458 |
| 0139742 | 10/1980 | Japan | 313/402 |
| 0059433 | 5/1981 | Japan | 313/402 |
| 0056345 | 3/1984 | Japan | 313/402 |

*Primary Examiner*—David K. Moore

*Attorney, Agent, or Firm*—Banner, Birch, McKie & Beckett

[57] ABSTRACT

A front end element, such as a shadow mask, for a color cathode ray tube is made from an alloy including iron and nickel as its principal components; and a black oxide layer is formed integrally on the alloy base. The black oxide layer consists essentially of a spinel-type oxide with the formula $Ni_xFe_{(3-x)}O_4$, where x is a positive number less than 3. A front end element constructed in this way produces a higher quality picture because of reduced thermal expansion.

18 Claims, 2 Drawing Figures

FRONT END ELEMENTS FOR A COLOR CATHODE RAY TUBE

BACKGROUND OF THE INVENTION

This invention relates to improvements in the front end elements, i.e., the shadow mask, mask frame, and inner shield, of a color cathode ray tube (CRT).

A color CRT, as shown in FIG. 1, generally comprises a glass envelope 1, in-line electron guns 3 emitting three electron beams 11, and a phosphor screen 5 containing red, green, and blue phosphors which emit visible light when excited by the electron beams 11. Electron guns 3 are located in the neck portion 2 of the envelope, while the phosphors, arranged in vertical stripes of cyclically repeating colors, are coated on the inner surface of the panel portion 4 of the envelope. Connecting neck 2 with panel 4 is the funnel portion 12 of the envelope. Electron beams 11 are deflected by magnetic fields produced by deflection yoke 10 surrounding a portion of the neck 2.

Near screen 5 is a shadow mask 6 having a plurality of vertically oriented rectangular apertures (not shown). Shadow mask 6 is attached to a mask frame 7 supported within the envelope by frame holders 8 which are releasably mounted on a plurality of panel pins 13 embedded in side walls of panel 4. An inner shield 9, also attached to mask frame 7, extends part of the way along funnel 12 toward electron guns 3, shielding the electron beams 11 from the effects of terrestrial magnetism. After emission from electron guns 3, electron beams 11 are accelerated, deflected by deflection yoke 10, and converged. They then pass through the apertures of shadow mask 6 to bombard phosphor screen 5, reproducing a color image.

The front end elements of the color CRT, i.e., shadow mask 6, mask frame 7 and inner shield 9, are conventionally made of aluminum-killed steel[1] because it is easily etched (to make apertures) and easily formed into the necessary shapes for the front end elements.

1 "Killed" steel, as is known in the art, is steel which has, while in the molten state, been caused to become quiet and free from bubbling by adding a strong de-oxidizing agent (such as aluminum) that combines with oxygen and minimizes reaction between oxygen and carbon during solidification. If the steel is incompletely de-oxidized, after solidification the outside portion is distinctly different in constitution from the interior of the ingot, and the material is known as "rimmed" steel.

Aluminum-killed steel is also easily coated with an oxide film, which helps to reduce reflection of the electron beams. Although conventional front end elements are coated with a black oxide film produced by a high temperature oxidation reaction, this oxide, which may be alpha $Fe_2O_3$ and $Fe_3O_4$, adheres poorly to the base and occasionally spills, since it contains voids.

With the recent emphasis on personnal computer displays, teletext, and satellite transmission, front end elements made of aluminum-killed steel, especially shadow masks, have been unable to meet the high standards for resolution and "comfortable viewing." (Comfortable viewing is a term of art referring in part to the ability to discern fine characters and images on the screen, i.e., high resolution, and in part to a brighter picture produced by increasing beam current.) Increased beam current, of course, increases the amount of heat which must be dissipated by the front end elements.

When a color CRT is energized, electron beam current raises the temperature of the front end elements to anywhere from 303 K. to 373 K. At those temperatures, the shadow mask is deformed by thermal expansion, giving rise to what is called the "doming phenomenon."

When this occurs, a misalignment comes about between the apertures of the shadow mask and the vertical stripes with which the apertures should be aligned. A color slippage phenomenon known as "purity drift" (PD) is the result. The smaller the apertures in the shadow mask, and the more closely spaced they are, and more serious is the color slippage problem. Since high resolution or "comfortable viewing" color CRTs use shadow masks with small, closely spaced apertures, the large thermal expansion coefficient of aluminum-killed steel makes it impractical for use with these color CRTs.

To overcome this problem, it has been suggested (in Japanese Publication No. 42-25446, Japanese Patent Disclosure No. 50-58977, and Japanese Patent Disclosure No. 50-68650) that shadow masks and other front end elements be made of an iron-nickel alloy which has a small coefficient of thermal expansion, such as Invar.[2] These alloys have the added advantage of being considerably harder than iron alone, so the closely-spaced apertures used in high definition television (HDTV) receiver shadow masks will not produce unaccetable weakening of the masks.

2 Invar is a trademark with Registration Number 63,970.

Although alloys of iron and nickel are desirable because of their hardness and their small coefficient of thermal expansion, they have the disadvantage of low thermal conductivity, causing them to retain heat. Consequently, these alloys still exhibit an undesirable amount of color slippage when used as shadow masks or other front end elements in color CRTs.

SUMMARY OF THE INVENTION

One object of the present invention is to improve the resolution and viewing comfort of a color CRT.

Another object of the invention is to reduce the purity drift of color CRTs.

Another object of the invention is to provide a front end element for a color CRT which has both a small coefficient of thermal expansion and high emissivity.

Another object of the invention is to provide such a front end element coated with a black oxide layer which adheres well.

The invention accomplishes the above and other objects by forming front end elements of a color CRT from an alloy including iron and nickel as its principal components and then oxidizing this base alloy to coat its surface with a black oxide layer consisting essentially of a spinel-type oxide. When used in this specification, the term spinel-type oxide refers to a compound with the general formula $J_xQ_{(3-x)}O_4$, where x is a positive number less than 3. In the present invention, J is nickel and Q is iron, so that the black oxide layer coating the iron-nickel base has the formula $Ni_xFe_{(3-x)}O_4$.

A color CRT front end element of this kind has a small coefficient of thermal expansion (because the base alloy includes iron and nickel as its principal components), yet is a good heat radiator because of the black oxide layer integrally formed on the base. The low thermal conductivity of iron-nickel alloys, a property which causes them to retain heat, is compensated by the excellent heat radiation characteristics of the black oxide layer. As a result, when a shadow mask or another front end element is made in accordance with this invention, the amount of doming caused by the rise in temperature during use, and the color slippage that accomplishes misalignment between the tiny apertures in the shadow mask and the phosphor stripes on the screen, are both reduced to a considerable degree. Therefore, a color CRT can be produced with the small closely spaced apertures necessary for high resolution and capable of using the high beam current needed for comfortable viewing.

DETAILED DESCRIPTION OF THE PREFERRED EMBODIMENT

The preferred embodiment of the invention will be described in connection with a shadow mask; however, the invention applies equally well to any front end element of a color CRT. The preferred iron-nickel alloy from which to form the shadow mask contains from 30 to 40 percent by weight[3] of nickel, and the remainder either iron with traces of other components or up to 7% by weight of cobalt and the rest iron, with traces of other components. The trace components may be, for example, silicon, magnanese, phosphorus, sulfur, chromium, aluminum, copper, zirconium, and titanium. Without cobalt, the alloy is known as Invar; with cobalt, with alloy is known as super Invar.

3 Whenever a composition is described by percentages of its components, the percentages are by weight, unless otherwise specified.

Figure 1:
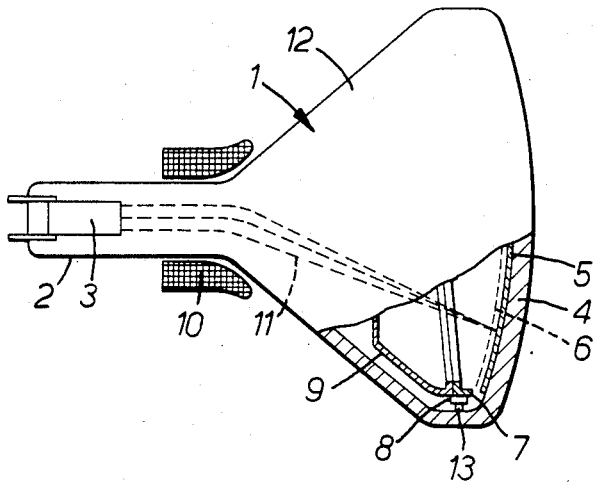
FIG. 1 is a sectional view of a color CRT which may incorporate the present invention.
Figure 2:
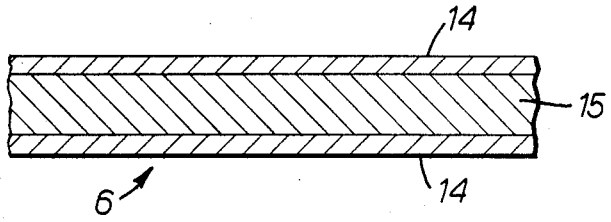
FIG. 2 is a sectional view of a front end element of the color CRT shown in FIG. 1.

As shown in FIG. 2, a shadow mask 6 manufactured in accordance with this invention includes a block oxide layer 14 on both surfaces of the base 15.

In order to manufacture such a shadow mask, an ingot of Invar is prepared having as its principal components 36% nickel and the remainder iron, along with traces of carbon, silicon, magnanese, phosphorous, sulfur, chromium, aluminum, copper, zirconium, or titanium. This ingot is annealed and formed by repeated cold working into a sheet of thickness 0.15 mm. A flat mask with a plurality of rectangular apertures is then prepared by etching this sheet in a well known manner using photoresist. The sheet is coated with the photosensitive material, exposed, developed, and then chemically etched. After the flat mask is washed and sheared, it is annealed at 1423 K. in a vacuum and pressed into the spherical shape of a shadow mask.

The mask is oxidized in an atmosphere of 25% oxygen and 75% nitrogen at a temperature of 873 K., causing the formation of an integral black oxide layer on its exposed surfaces. The black oxide layer formed integrally on the surface of the base alloy is a spinel-type oxide with the formula $Ni_xFe_{(3-x)}O_4$, where x is a positive number less than 3 and, when super Invar is used, having cobalt solid-dissolved in it. The concentration of nickel in this black oxide layer may vary with depth, a higher concentration generally occurring near the interface between the base and the oxide layer and a lower concentration occurring at the surface of the material. During oxidation, nickel atoms diffuse inward away from the surface, while iron atoms (and cobalt atoms, if present) diffuse toward the surface. Under appropriate conditions, however, a uniform nickel distribution can be obtained. In addition to the spinel-type oxide (and solid-dissolved cobalt), minute amounts (less than one percent by weight) of the trace elements mentioned above, which are unavoidably contained in the base alloy, may also be present in the black oxide layer. It is believed that the growth rate of the oxide layer may be controlled by controlling the amounts of these trace elements in the base alloy, because they substitute for nickel in the black oxide layer.

A layer of red iron oxide (alpha $Fe_2O_3$) having a perovskite structure may be formed on the surface of the spinel-type oxide, but it is extremely thin and does not affect the emissivity of the black oxide layer.

When the adhesion of the black oxide layer to the base is tested by an adhesive tape peeling test, there is no peeling of the black oxide layer from the base. The adhesive tape peeling test is performed by first pending the element to a 90° angle, then straightening it, and then applying adhesive tape and peeling it off by hand. Adhesion is particularly good in an oxide of the formula $Ni_xFe_{(3-x)}O_4$ when x is in the range of 0.03 to 1.5, inclusive.

When a shadow mask produced in this way is used in a color CRT, a stable image is obtained. Furthermore, measurements of the value of purity drift have been made; these measurements confirm that the purity drift obtained with this invention is considerably smaller than that obtainable with a conventional shadow mask. Purity drift is measured by projecting an electron beam through an aperture of a shadow mask and onto the phosphor coated screen, then measuring the displacement of the electron beam projection, due to thermal expansion of the shadow mask, from the ideal position of the projection. With conventional shadow masks, a typical value of purity drift is 120 um, whereas the purity drift available with a shadow mask manufactured in accordance with this invention is less than 90 um. Moreover, with the present invention the time necessary to recover from transient purity drift is cut in half.

When the thickness of the black oxide layer is less than about 10 um (for example 1 um) it is a dense black with good heat radiation characteristics. The emissivity of the black oxide layer has been found to be 0.5 (compared with the emissivity of a perfect black body, which is 1.0).

If the iron-nickel alloy includes 5% to 10% chromium, it may be more easily formed into a shadow mask (or other front end element), because its yield strength is decreased. If an iron-nickel alloy including 5% to 10% chromium is used, the black oxide layer will be composed of a spinel-type oxide which has chromium substituted for part of the nickel in the formula $Ni_xFe_{(3-x)}O_4$.

Of course, this invention is applicable to all front end elements of the color CRT, such as the mask frame and the inner shield. If these elements are also made of an iron-nickel alloy and coated with the black oxide layer of this invention, the heat developed in the shadow mask by electron beam current is conducted to the mask frame and the inner shield and quickly radiated from these elements.

Although illustrative embodiments of the present invention have been described in detail with reference to the accompanying drawings, it is to be understood that the invention is not limited to those precise embodiments and that various changes and modifications may be effected therein by one skilled in the art without departing from the scope or spirit of the invention.

We claim:

1. A front end element for a color cathode ray tube, said front end element being selected from the group consisting of a shadow mask, a mask frame, and an inner shield, said front end element having:

a based consisting of an alloy having iron and nickel as its principal components; and a black oxide layer formed integrally on said base, said black oxide layer consisting essentially of complex oxide material including iron and nickel, said complex oxide material having a spinel-type structure.

2. A front end element as claimed in claim 1 wherein said complex oxide further includes solid-dissolved cobalt.

3. A front end element as claimed in claim 1 wherein said complex oxide material has the formula $Ni_xFe_{(3-x)}O_4$, where x is a positive number less than 3.

4. A front end element as claimed in claim 3 wherein said complex oxide material further includes solid-dissolved cobalt.

5. A front end element as claimed in claim 3 wherein x is in the range from 0.03 to 1.5, inclusive.

6. A front end element as claimed in claim 4 wherein x is in the range from 0.03 to 1.5, inclusive.

7. A front end element as claimed in claim 1 wherein said alloy is Invar.

8. A front end element as claimed in claim 2 wherein said alloy is super Invar.

9. A front end element as claimed in claim 1 wherein said black oxide layer is less than 10 um in thickness.

10. A front end element as claimed in claim 2 wherein said black oxide layer is less than 10 um in thickness.

11. A front end element as claimed in claim 3 wherein said front end element comprises a shadow mask.

12. A front end element as claimed in claim 4 wherein said front end element comprises a shadow mask.

13. In a color cathode ray tube comprising an envelope having a neck portion at one end and a panel portion at another end, electron gun means in said neck portion for emitting an electron beam, a phosphor screen on an inner surface of said panel portion to emit light upon bombardment by the electron beam, a shadow mask having a plurality of apertures, a mask frame supporting said shadow mask at a predetermined distance from said phosphor screen, and an inner shield attached to said mask frame to shield the electron beam from magnetic flux, the improvement wherein at least one of said shadow mask, said mask frame, and said inner shield comprises:

a base consisting of an alloy having iron and nickel as its principal components; and a black oxide layer formed integrally on said base, said black oxide layer consisting essentially of complex oxide material including iron and nickel, said complex oxide material having a spinel-type structure.

14. The improved color cathode ray tube of claim 13 wherein said complex oxide material further includes solid-dissolved cobalt.

15. The improved color cathode ray tube of claim 13 wherein said complex oxide material has the formula $Ni_xFe_{(3-x)}O_4$, where x is a positive number less than 3.

16. The improved color cathode ray tube of claim 15 wherein said complex oxide material further includes solid-dissolved cobalt.

17. A front end element as claimed in claim 3 wherein said alloy contains from 30 to 40 percent by weight of nickel.

18. A front end element as claimed in claim 4 wherein said alloy contains from 30 to 40 percent by weight of nickel.

* * * * *